United States Patent [19]

Gustavs et al.

[11] 3,960,081

[45] June 1, 1976

[54] DRYING ARRANGEMENT FOR DRYING INKS, ADHESIVES AND ANALOGOUS SUBSTANCES ON SHEET MATERIAL

[75] Inventors: Helmut Gustavs, Steinhagen; Ernst Dudziak, Gutersloh, both of Germany

[73] Assignee: Mohndruck Reinhard Mohn OHG, Gutersloh, Germany

[22] Filed: May 10, 1974

[21] Appl. No.: 468,115

[30] Foreign Application Priority Data

May 11, 1973 Germany ..... 2323792
Feb. 19, 1974 Germany ..... 2407823

[52] U.S. Cl. ..... 101/416 A; 34/13; 34/41

[51] Int. Cl.[2] ..... B41F 23/00

[58] Field of Search ..... 34/13, DIG. 10, 41, 34/4; 101/416 A; 117/119.6; 174/138 H, 138 J; 338/53, 55; 210/435, 183

[56] References Cited

UNITED STATES PATENTS

| | | | |
|---|---|---|---|
| 1,878,318 | 9/1932 | Pinder | 101/416 A |
| 2,254,838 | 9/1941 | Conklin et al. | 338/55 |
| 2,274,381 | 2/1942 | Richardson | 338/55 |
| 2,338,531 | 1/1944 | Naumann et al. | 338/53 |
| 2,412,462 | 12/1946 | Marsten | 338/55 |
| 2,428,003 | 9/1947 | Beam et al. | 338/53 X |
| 2,593,595 | 4/1952 | Offen | 101/416 A |
| 2,674,809 | 4/1954 | Meienhofer | 34/41 X |
| 2,678,986 | 5/1954 | Ward | 338/53 X |
| 2,703,224 | 3/1955 | Robinson | 101/416 A |
| 2,722,316 | 11/1955 | Goscilo | 210/435 X |
| 2,778,866 | 1/1957 | Sanz et al. | 338/55 X |
| 3,008,242 | 11/1961 | Sites et al. | 101/416 A |
| 3,052,358 | 9/1962 | Stoermer | 210/182 X |
| 3,085,143 | 4/1963 | Antoncich | 101/416 A |
| 3,087,253 | 4/1963 | Wulf | 34/13 X |
| 3,187,162 | 6/1965 | Hojo et al. | 34/41 X |
| 3,226,249 | 12/1965 | Bakel et al. | 117/119.6 |
| 3,327,274 | 6/1967 | Nelson et al. | 338/53 X |
| 3,446,142 | 5/1969 | Vandenberg | 34/41 X |
| 3,495,204 | 2/1970 | Kesselring | 338/55 X |
| 3,571,566 | 3/1971 | Kuzara | 174/138 J |

*Primary Examiner*—Edgar S. Burr
*Assistant Examiner*—Paul J. Hirsch
*Attorney, Agent, or Firm*—Michael J. Striker

[57] ABSTRACT

Sheet material carrying ink, lacquer, adhesive or some other substance requiring to be dried, is advanced in a path in which its major surfaces are exposed. A drying arrangement, including a source of UV radiation and of incidental IR radiation, is located adjacent this path and directs the UV radiation against the substance to be dried, so as to effect such drying. A cooling arrangement is provided which at least partially surrounds the source of UV radiation in order to counteract the heat of the incidental IR radiation and prevent damage to the sheet material and/or the equipment.

38 Claims, 16 Drawing Figures

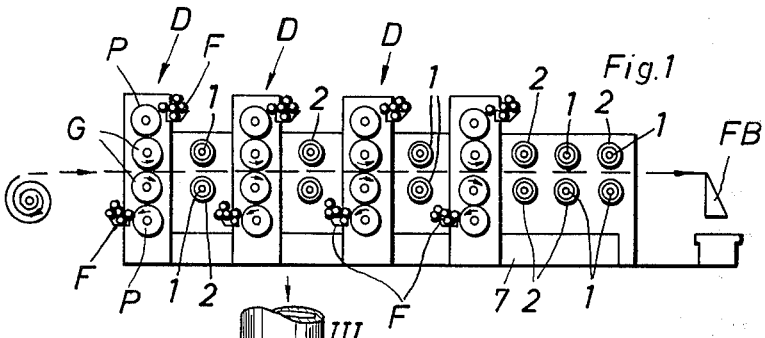
Fig.1
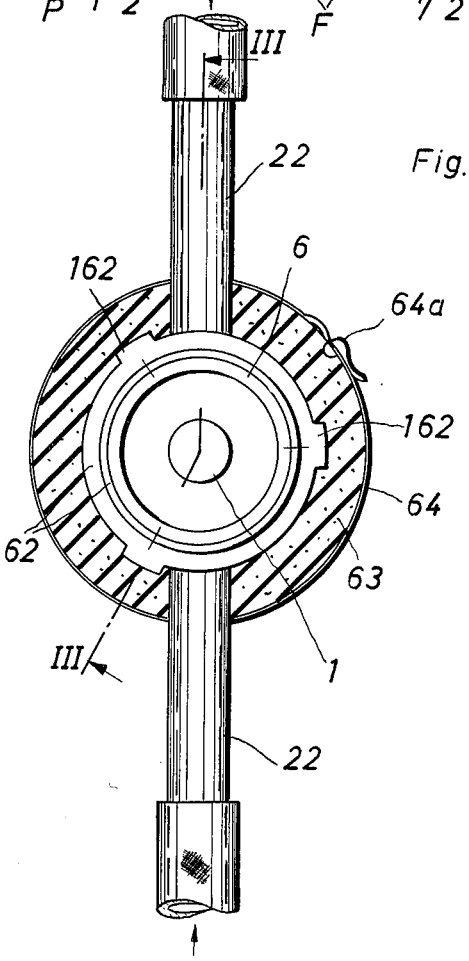
Fig.2
Fig.2a
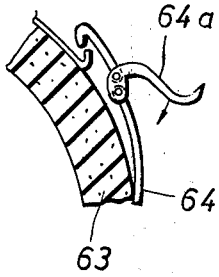

DRYING ARRANGEMENT FOR DRYING INKS, ADHESIVES AND ANALOGOUS SUBSTANCES ON SHEET MATERIAL

BACKGROUND OF THE INVENTION

The present invention relates to the drying of inks, lacquers, adhesives and the like, and more particularly to a drying arrangement for effecting such drying.

It is known, particularly from printing machines such as offset printing machines, that inks, lacquers, adhesives and similar substances which are applied on sheet material such as paper, cardboard, synthetic plastic foils or the like, must be dried during the travel of the sheet material through a machine, such as a printing machine. Equipment for this purpose exists in the art, and usually involves large drying apparatuses requiring the circulation of heated air. This equipment is very large and thus requires space which is often at a premium, it is complicated and expensive to produce and it requires almost constant servicing, all of which makes this prior-art equipment disadvantageous from an economic point of view.

In recent times substances have been developed, such as inks and the like, which cannot even be dried at all with the type of equipment mentioned above. These substances can be dried only by ultraviolet (UV) radiation, since the drying of the substances is based upon a polymerization action which takes place only when the substances are subjected to ultraviolet radiation of a certain intensity and wavelength. Since there are such substances in use, and have become very popular in the industry, the prior art has developed equipment for drying them. Thus, it is known from German Pat. No. 2,221,930 to provide a drying arrangement utilizing a source of UV radiation which is directed against the substances to be dried. One or more substantially tubular radiation sources extend transversely of the path of movement of the sheet material carrying the substance to be dried, and they are provided with reflectors which serve to direct all of the emitted UV radiation against the exposed surface or surfaces of the sheet material in order to dry the substance or substances thereon.

The difficulty with utilizing UV radiation for the drying of substances of the type outlined earlier on sheet materials is that it is impossible to produce UV radiation without at the same time also producing a significant amount of infrared (IR) radiation. The higher the value of the UV radiation, the higher the value of the incidentally produced infrared radiation. Infrared radiation, of course, means heat and this, in turn, brings with it the very substantial possibility that the sheet material, and even parts of the apparatus in which the drying arrangement is utilized, might become damaged by the significant amount of heat which is thus developed. The sheet material might, for instance, shrink, become excessively dry or might even burn or melt in the case of synthetic plastic foils.

The aforementioned German patent proposes to use a cooling arrangement for the radiation sources, in form of a blower which blows adjustable quantities of cooling air along the reflectors so as to carry off the undesired heat which should not reach the sheet material. The patent also realizes that under certain circumstances, for instance if the printing machine in which such a drying arrangement might be utilized, should malfunction and have to be stopped, the heat of the incidental IR radiation might become so great as to cause burning of the sheet material. To avoid this possibility, it is proposed to utilize flaps or baffles which in the event of machine malfunction are moved to a position in which they become interposed between the sheet material and the radiation source or sources, in order to protect the sheet material from direct radiation and possible damage.

This prior-art construction also is not fully satisfactory. On the one hand, it is expensive to produce since it is quite complicated. On the other hand, and even more importantly, it does not—despite the attempts made—preclude the possibility that the sheet material or parts of the surrounding equipment might become damaged due to heat. Even when the safety baffles are in place, the incidental IR radiation can cause heating of the safety baffles to temperatures of approximately 400°C, and quite evidently these temperatures are sufficient to result in combustion of the sheet material even though the baffles are in place, since the distance at which the radiation source can be located from the sheet material (and hence the distance at which the interposed baffles can be spaced from the sheet material) is necessarily limited.

Moreover, the aforementioned prior-art arrangement cannot be used at all in certain applications. For instance, in printing machines in which individual sheets of material are engaged—usually by grippers of synthetic plastic material—to be transported along, this type of drying arrangement would heat the plastic grippers excessively and would cause damage to them.

Another drawback is the fact that in order to make the baffles tiltable to and from their closed positions, it is necessary that pivots be provided and arrangements for effecting the pivoting, and that they must all be located directly in the vicinity of the radiation source, so that they are subjected to the IR radiation. This means that only high-quality specialty materials can be employed for the manufacture of these components, and evidently this makes the prior-art arrangement even more expensive.

SUMMARY OF THE INVENTION

Accordingly, it is a general object of the invention to provide an improved drying arrangement of the type in question, which avoids the disadvantages of the prior art.

More particularly, it is an object of the present invention to provide a drying arrangement which makes it possible to use large, and hence very effective, sources of UV radiation, particularly in conjunction with printing machines, without having to fear any possibility of damage to components of the machine and/or the sheet material against which the radiation is directed.

An additional object of the invention is to provide such a drying arrangement wherein the danger of damage to the sheet material and/or components of the machine is avoided even if the machine should come to a standstill, for instance due to a malfunction.

Still a further object of the invention is to provide such a drying arrangement which is relatively simple to construct and inexpensive compared to what is known from the prior art.

In keeping with these objects, and with others which will become apparent hereafter, one feature of the invention resides in a drying arrangement for drying inks, adhesives, lacquers and analogous substances on sheet material, particularly a drying arrangement for use in offset printing machines, which comprises guide means for guiding the sheet material in a path in which the major surfaces of the sheet material are exposed, drying means including a source of UV radiation and of incidental IR radiation, which is located adjacent the path and operative for directing the UV radiation against at least one of the major surfaces so as to dry a respective one of the substances thereon, and cooling means which at least partially surrounds the source for counteracting the heat of the incidental IR radiation.

The arrangement according to the present invention makes it possible to cause drying of the substances in question, by effecting the desired polymerization, at a relatively rapid rate due to the large UV sources which can be utilized. On the other hand, the present invention eliminates the transmission of any significant amounts of heat to the sheet material and to surrounding components of the machine. In fact, the increase in the temperature of the sheet material resulting from the incidental IR radiation, amounts to only a few degrees C because the heat which develops due to the incidental IR radiation is carried away by the cooling means. The exterior temperature of the cooling means is quite low, for instance less than approximately 90°C, despite the fact that it is possible to use UV sources having a capacity of 100 watts per centimeter of length, and despite the fact that such sources may have a total length of 1.50 to approximately 2 meters. When such sources are utilized, the temperature when measured directly at the source of radiation is approxmately 900°C, but the exterior temperature of the cooling means is, as pointed out before, only on the order of approximately 90°C. It is evident that this makes it possible to employ such radiation sources for drying of inks, adhesives, lacquers and analogous substances on paper, cardboard, synthetic plastic foil and even sheet metal, without having to fear that any damage might result due to excessive heating.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a diagrammatic side view illustrating how the present invention can be incorporated in a rotary offset printing machine;

FIG. 2 is an end view of the embodiment shown in FIG. 3;

FIG. 2*a* is a fragmentary sectional detail view of FIG. 2;

DESCRIPTION OF THE PREFERRED EMBODIMENTS

Figures 3, 4, 5, 5A:
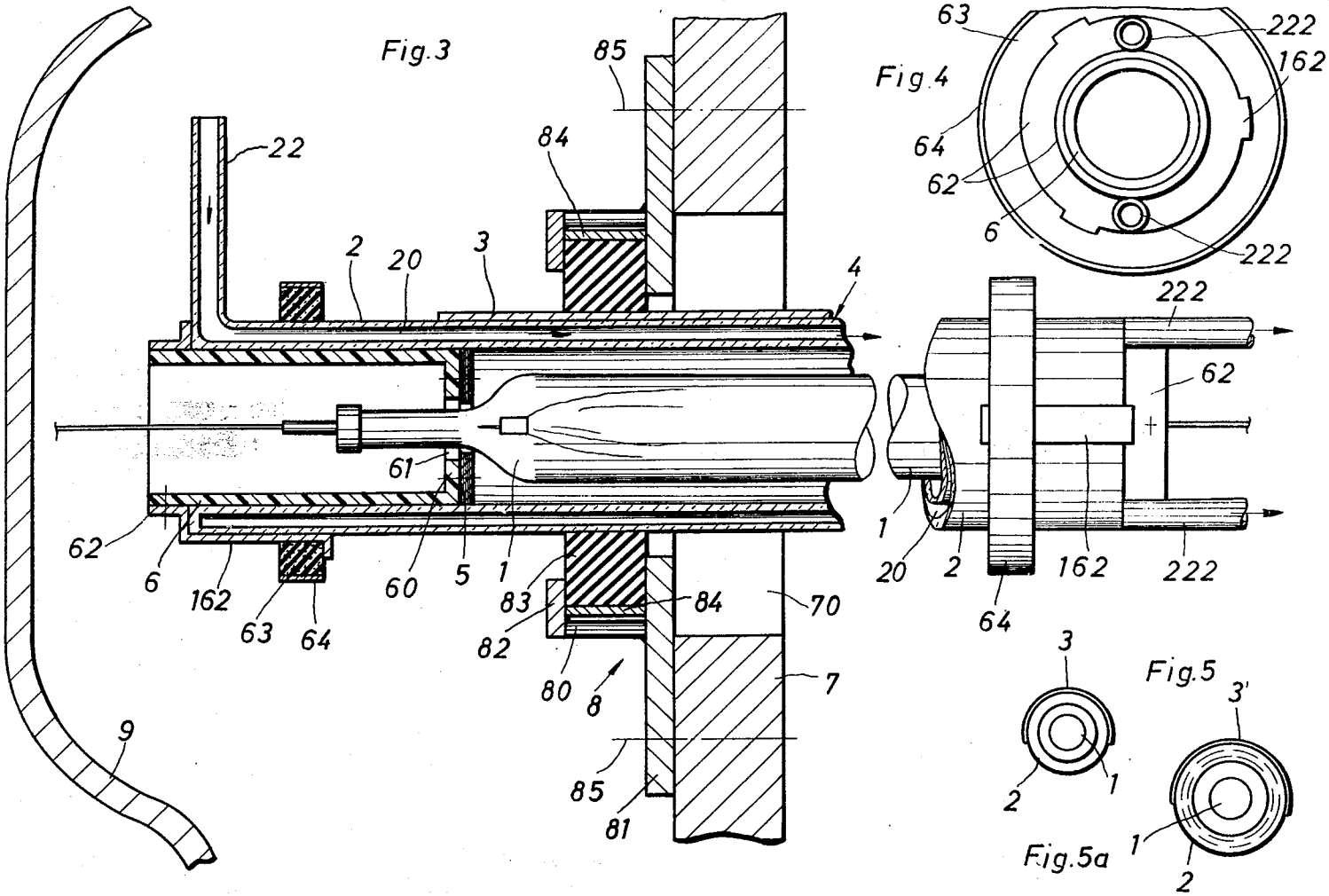
FIG. 3 is a section taken on line III—III of FIG. 2.
FIG. 4 is an end view of FIG. 3, looking towards the left.
FIG. 5 is a diagrammatic end view showing a UV source with cooled surrounding tube and reflector.
FIG. 5*a* is a view similar to FIG. 5 but illustrating a slightly different embodiment.

Referring firstly to FIGS. 2 and 3 of the drawing, it will be seen that reference numeral 1 identifies an elongated source of UV radiation and of incidental IR radiation. Such sources are tubular and elongated and their elongation is chosen so that they extend over the entire width of a sheet material to be subjected to UV radiation. For instance, the source 1 may have a length of 1.5 or 2 meters, and its capacity may be in the area of 100 watts per centimeter of length. Such UV radiation sources 1 are known and are in use in the industry; they are, for instance, available from Quarzlampen - gesellschaft, Hannover, West Germany.

According to the present invention the source 1 is located in a cooling tube or jacket 2 which surrounds the source 1 with spacing. The tube 2 may be generally of a vitreous material which can be penetrated by the UV radiation, such as glass, or as is currently preferred, quartz glass. The tube 2 is double-walled so that its two walls together define a clearance or space 20 through which a cooling medium, such as a gaseous or liquid medium, can be circulated. The cooling medium may simply be air or water. If air is utilized, then recourse may be had to the construction illustrated in FIG. 1a wherein reference numeral 7 identifies the frame of the machine in which the source 1 and the tube 2 are mounted in a manner which is to be described later. A reservoir R receives water, for instance from the illustrated faucet or the like, and the pump P draws the water out of the reservoir and passes it through any conventional heat exchanger K and subsequently through the inlet nipples 22 which communicate—in a manner still to be described—with the cooling jacket of the tube 2, whereupon the warmed water leaves the cooling jacket through the outlet nipples 222 and can then either be discharged, or can be recirculated into the reservoir R.

Figure 1A:
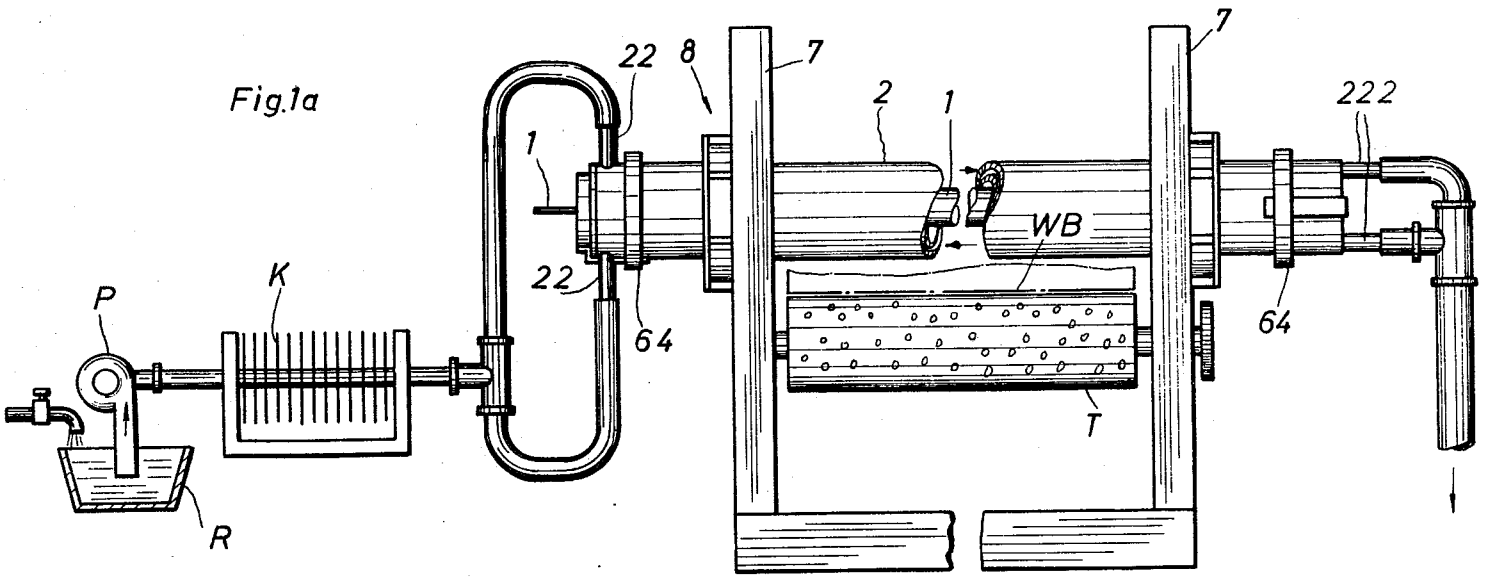
FIG. 1*a* is a fragmentary detail view illustrating a detail of an embodiment of the invention.
Figure 1B:
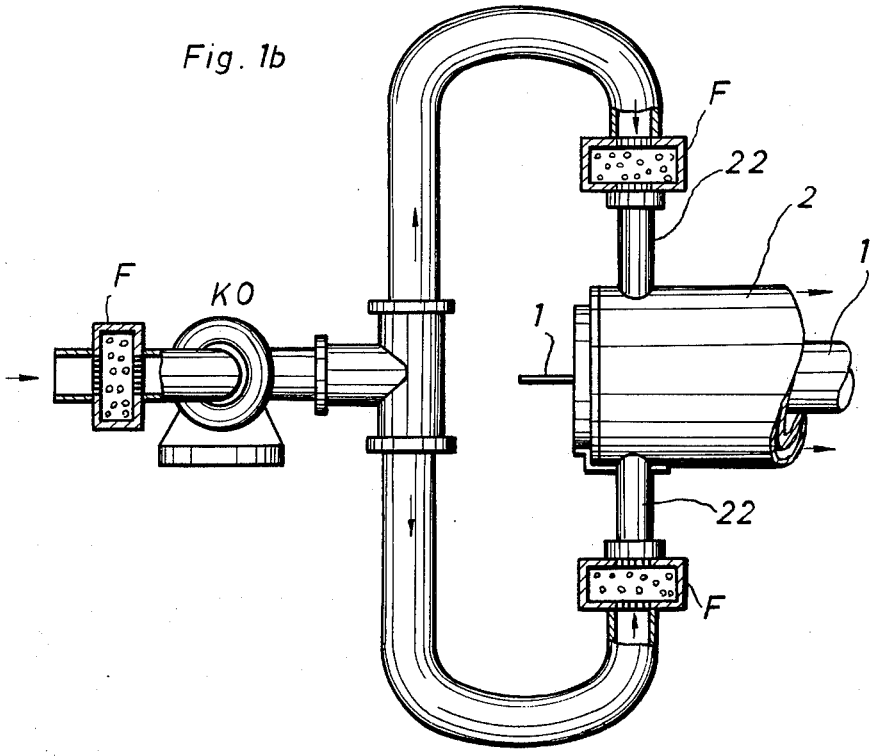
FIG. 1*b* is another fragmentary detail view showing a further detail of an embodiment of the invention.

If gas or air is used for cooling purposes, then the arrangement of FIG. 1b may be utilized, wherein air is first drawn in the direction of the arrow through a filter F to remove possible contaminants from it, whereupon it enters a compressor KO and is then forwarded to the inlet nipples 22 which communicate with the cooling jacket of the tube 2, from where it can be discharged in the manner described with reference to FIG. 1a. Upstream of the cooling nipples 22 additional filters F may be located to further remove even very small contaminants from the air.

As FIGs. 2 and 3 show most clearly, the tube 2 may be formed with the aforementioned cooling jacket 2, and it is also provided with one or more inlet nipples 22 (one shown in FIG. 3 and two each shown in FIGS. 1*a* and 1*b*), and with the outlet nipples 222. The nipples 22 and 222 may be located at opposite axial ends of the tube 2 and are advantageously of the same vitreous material as the remainder of the tube 2. It is advantageous, but not absolutely necessary, if the inlet nipple or nipples 22 are arranged radially with respect to the tube 2, whereas the outlet nipple or nipples 222 extend axially with reference to the tube 2. If two each of the nipples 22 and 222 are provided, then advantageously they will be located opposite one another, as shown with respect to the nipples 22 in FIGS. 1*a* and 1*b* and as illustrated with reference to the nipples 222 at the right-hand end of FIG. 3. The advantage of having the nipples 22 and 222 of the same material as the remainder of the tube 2 is, of course, to avoid stresses due to differential expansion or contraction of different materials for the tube 2 and the nipples. The latter can be connected with suitable hoses or conduits through which the cooling fluid can be readily circulated. The amount of cooling fluid circulated through the jacket 2 per unit of time, for instance per minute, can be varied depending upon the cooling effectiveness that is to be obtained. Evidently, devices for varying the flow of fluid per unit of time are so well known that they need not be described or illustrated herein.

FIGS. 5 and 5*a* show in particular how a UV reflector can be applied on the tube 2. This can either be done by painting or spraying a layer of aluminum paint onto the tube 2, as shown in FIG. 5, to obtain the reflector 3, or else a layer of aluminum sheet or foil—which may be anodized—is applied onto the outer surface of the tube 2 to form the reflector 3′ thereon, as shown in FIG. 5*a*. In the latter case, a bonding agent is required, identified with reference numeral 4 in FIG. 3, which must be of a type that is fully penetrable by UV radiation, since otherwise the reflector 3′ could not perform its intended reflecting function. The reflector must self-evidently be located at a side of the tube 2 which is remote from the sheet material surface against which the UV radiation is to be directed. The angle of reflection can be freely chosen, depending upon the extent to which the tube 2 is surrounded by the reflector 3 or 3′. The possibilities shown in FIG. 5 and 5*a* are particularly advantageous, because they are relatively simple and inexpensive, and there is no possibility for dirt or other contaminants to become seated on the surface of the tube 2 intermediate the same and the respective reflector. However, if desired, a separate reflector could also be provided and spaced from the tube 2, as will be described in more detail with reference to FIG. 9.

It is important that the source 1 be properly mounted in the cooling tube 2. For this purpose, packets of mica discs 5 are inserted into the opposite axial ends of the tube 2, and subsequently a cup-shaped mounting member 6 is also inserted, having a transverse bottom wall 60 which is formed with an opening 61 through which one end portion of the source 1 extends. These cup-shaped members are advantageously of a compressed mixture of mica and synthetic plastic material, but generally any heat-resistant material capable of withstanding the temperatures involved, can be utilized. The members 6 determine the spacing of the source 1 from the walls of the tube 2, and also serve for a rapid mounting of the source.

FIG. 3 shows particularly clearly that the members 6 (only one shown in this FIGURE) are Figure) within the confines of a press-material ring 62 of thermally resistant material. The ring is stepped as shown, and is provided with a plurality of axially extending tongues 162 the outer ends of which are radially outwardly bent and which tongues extend axially of and are located exteriorly of the tube 2, so that that latter is slipped between them. The ring 62 may be connected with the member 2 by means of screws, rivets or the like. A ring of synthetic plastic foam material of the resiliently compressible type is identified with reference numeral 63 and slipped over the tongues 162. A tensioning strap 64 surrounds the circumference of the ring 63 and thus presses the same resiliently against the tongues 162 and the latter against the tube 2, without causing damage to the tube or causing stresses in the tube material. The strap 64 can be tenssioned by means of a known arrangement such as is shown in FIG. 2a wherein a closure 64a is provided having two hooks at opposite ends of the strap 64 and a lever which, when moved in the direction indicated by the arrow in FIG. 2a, will tension the strap 64.

It is advantageous if both ends of the source 1 are mounted in this manner, as shown in a comparison of FIGS. 3 and 4, since this is a particulary simple and reliable way of mounting them and, also, since to remove the source 1 it is merely necessary to release the straps 64 and thereupon to draw the tongues 162 out from the readily compressible ring 63, whereupon the entire member 6 with the ring 62 and the package 5 of mica discs can be withdrawn from the tube 2, together with the source 1. rollers It is important that the source 1 and the tube 2 are mounted in the machine frame in such a manner as to be protected to the maximum possible extent against vibrations and the like. For this purpose, the frame 7 is provided with bores 70 which must be larger (e.g., by approximately 15–20 mm) than the outer diameter of the tube 2. Mounting arrangements 8 are mounted so as to register with these openings or bores 70, and each of these mounting arrangements is composed of a double flange having two parts 71 and 72 which are spaced from one another by spacing bolts 80 or the like. Located in the space between the flanges 81 and 82 is a ring 83 of synthetic plastic foam material which is again surrounded by a tensioning strap 84 utilizing the type of quick-release tensioning closure shown in FIG. 2*a*. When the closure is operated, the ring 83 is slightly and resiliently pressed against the tube 2 and provides a firm but resiliently yieldable connection which precludes, inter alia, axial displacement. The mounting arrangement 8 can be connected with the frame 7 by means of screws 85 or the like, and serves the additional purpose of properly centering the cooling tube 2 and the source 1 with reference to one another. With such a construction, vibrations and other movements are almost completely precluded from being transmitted from the machine frame 7 into the tube 2 and the source 1.

The entire mounting arrangements can be covered by a cap or cover 9 of synthetic plastic material or the like, and this cap, cover or hood 9 must, of course, be provided with openings through which the conduits can pass which are to be connected with the nipples 22, 222.

The arrangement discussed and illustrated with reference to the preceding Figures can be utilized in a variety of ways in a printing machine. Thus, FIGS. 1 and 7 show how the drying arrangements according to the present invention can be located intermediate respective printing stations of a printing machine.

Figure 6:
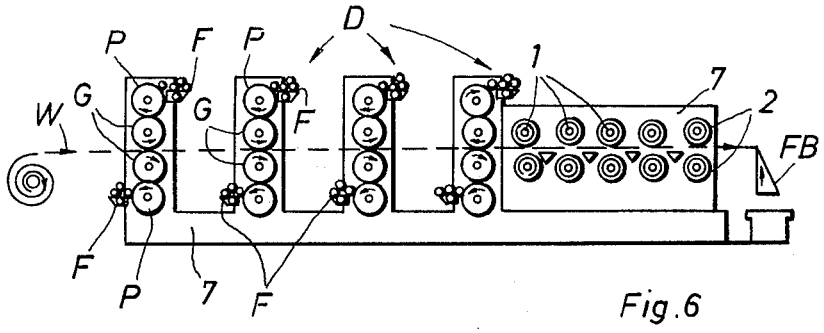
FIG. 6 is a diagrammatic view showing in a side illustration a rotary offset printing machine provided with drying arrangements according to the present invention.
Figure 7:
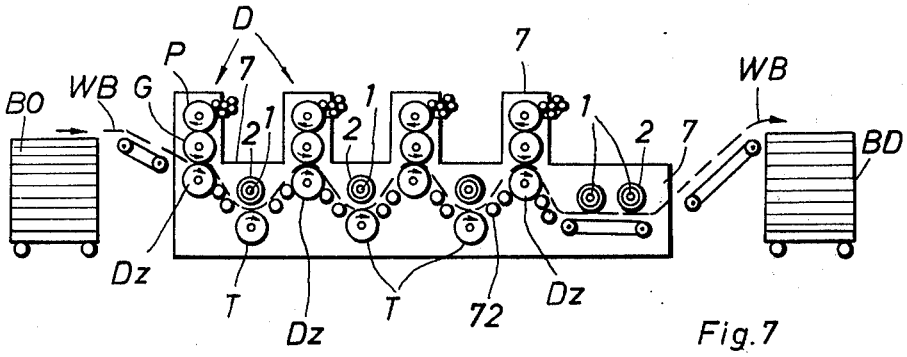
FIG. 7 is a view similar to FIG. 6, but illustrating a sheet printing machine provided with drying arrangements according to the present invention which are located differently than in FIG. 6.
Figure 8:
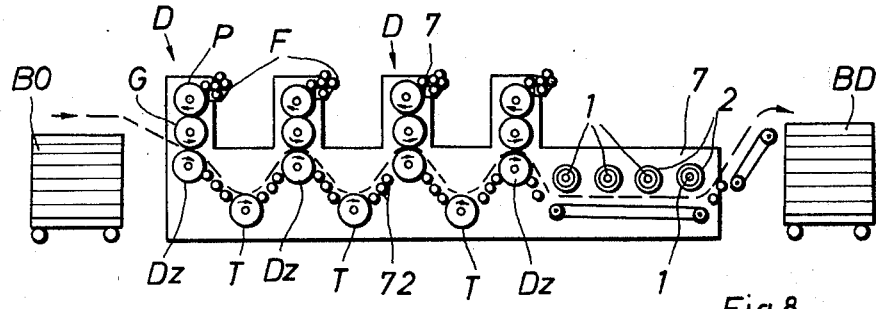
FIG. 8 is a view similar to FIG. 7, but illustrating the machine of FIG. 7 with the drying arrangements arranged in a different manner.

I particular, FIGS. 1 and 6 show so-called blanket-to-blanket printing machines in which continuous webs of sheet material are processed, whereas FIGS. 7 and 8 show printing machines in which individual sheets of sheet material are processed.

In the several printing machines shown in FIGS. 1, 6, 7 and 8, reference character T identifies transfer drums. In FIG. 7 and the other Figures mentioned above, reference character P identifies the plate cylinder, reference character G the offset or blanket cylinder. Reference character F identifies inking units which supply ink to the plate cylinders P which carry the offset plate. The ink is always applied to the cylinders, never directly onto the sheet material.

The plate cylinders are in each case provided with an inking unit F and carry the offset plates which may be of aluminum. The plate cylinders always cooperate with a blanket cylinder which is associated with the sheet material W. Printing onto the sheet material W is the result of the elastic characteristic of the surface on the blanket cylinders, and the surface—i.e., of rubber—permits the penetration of the ink into all depressions of the sheet material on which printing is to be carried out. Since the actual rubber layer is provided on the blanket cylinder, which can also be considered the offset cylinder and which is completely smooth, it is possible in the case of offset printing to print both sides of the sheet material simultaneously, as shown in FIGS. 1 and 6. The inking units F are always located at opposite sides of the major surfaces of the sheet material w and are each composed of a plurality of smaller rollers, namely an ink pickup roller and an appropriate number of ink distributing rollers which distribute and apply the ink to the offset plate of the plate cylinder.

In FIGS. 1, 6, 7 and 8 reference character D identifies respective printing stations each of which is composed of one of the inking units F, a plate cylinder P with the offset plate and a blanket cylinder G. In these several Figures four printing stations D are illustrated, to obtain four-color printing.

If the printing station D does not print simultaneously on both sides of the sheet material W, when a lower cylinder is utilized as shown in FIGS. 7 and 8 which acts as a pressure cylinder Dz and these are, of course, different from the transfer drums T of FIGS. 7 and 8.

At the right-hand end of FIG. 6 there is illustrated a folder FB (also shown in FIG. 1) where the sheet material is folded and possibly also trimmed to a desired format.

FIGS. 7 and 8 show at the left-hand sides stacks BO of sheets of sheet material, and at the right-hand side they show stacks BD of printed sheets of sheet material. Devices for supplying and removing the sheets into and out of the respective machine have been diagrammatically illustrated, and may be replaced with the gripper chains 72 which will still be discussed with reference to FIG. 9.

FIGS. 1 and 7 show that the arrangements for drying purposes as disclosed in the present application may be located intermediate the respective printing stations D. FIGS. 6 and 8 show that the arrangements 1 can be utilized only upstream of the output arrangements of the machine, in which case a plurality of the arrangements 1 will be required to obtain the desired drying effect, and it is, of course, also possible to combine the utilization of the arrangements 1 intermediate the output arrangement and the terminal printing unit D with an arrangement where additional ones of the arrangements 1 are also located intermediate successive ones of the printing units D. In the latter case, fewer of the arrangements 1 will be required immediately upstream of the output unit.

Figure 10:
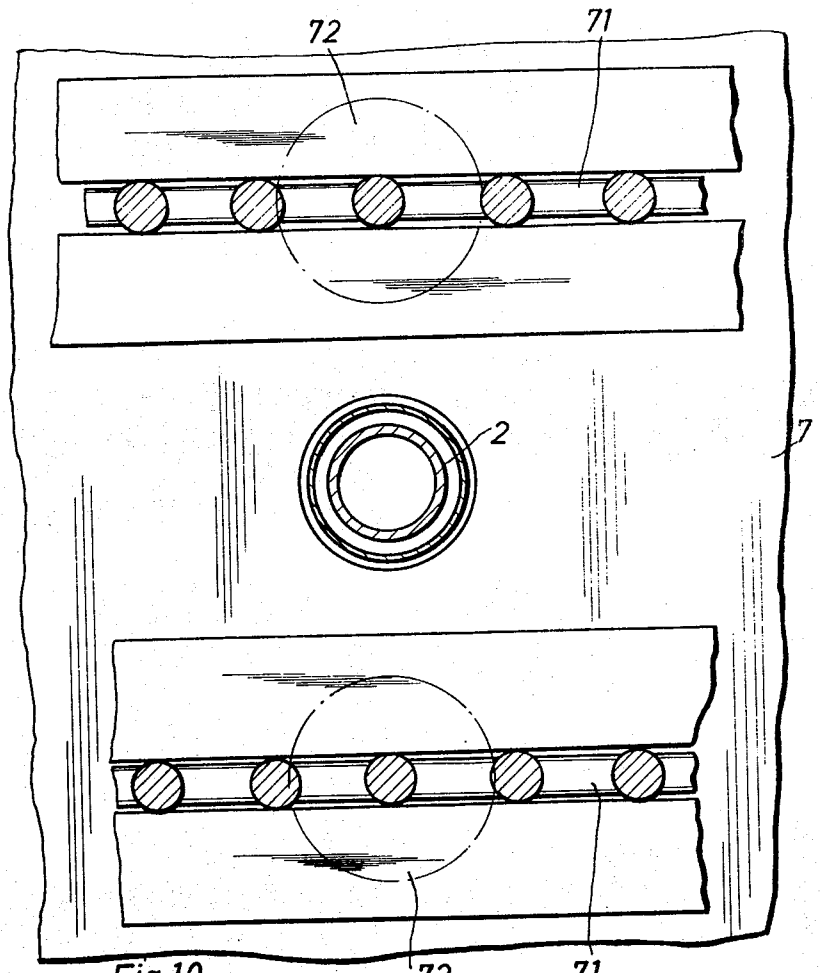
FIG. 10 is a fragmentary section taken on line X—X of FIG. 9.
Figure 9:
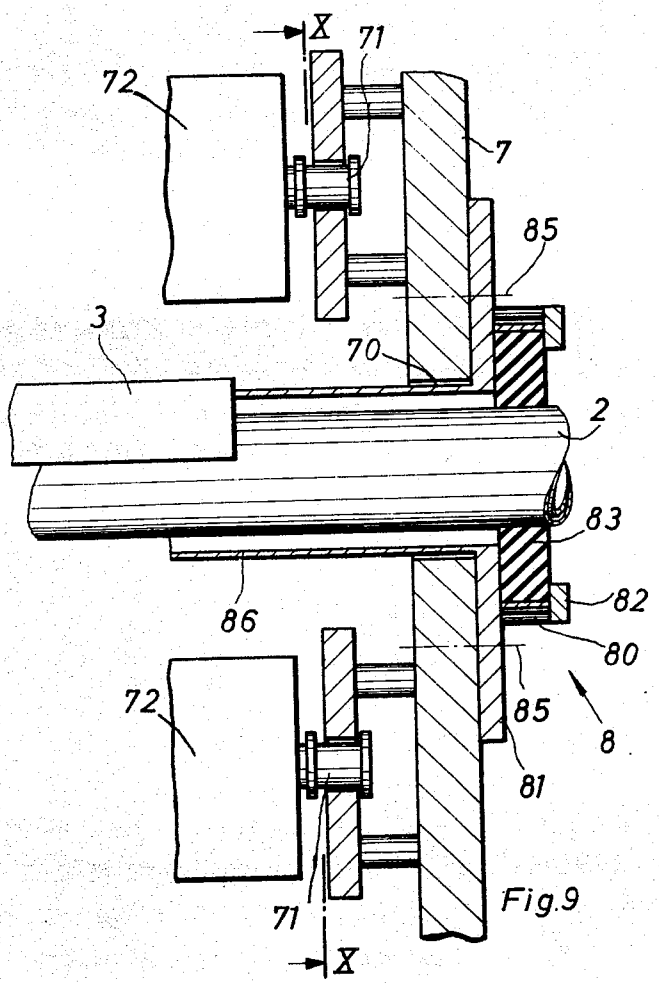
FIG. 9 is a partially sectioned detail view showing a detail of a further embodiment of the invention.

Turning now to FIGS. 9 and 10, it will be seen that we have diagrammatically illustrated in these Figures how the arrangements according to the present invention can also be utilized in a printing machine having chain-type conveyors arranged to form an upper and a lower run. Such conveyors are particularly used on offset printing machines which print individual sheets, rather than continuous webs of sheet material, Reference numeral 7 identifies again the machine frame, formed with the bores 70 which have been previously described, and the units 8 are again employed, having the flanges 81. The flange 81 may be formed or provided with a tubular socket 86 which extends through the opening 70 inwardly, and which can carry a separate hood-shaped reflector 3 of aluminum sheet material or the like. The sockets 86 surround the tube 2 with clearance as shown. Of course, an arrangement such as the one shown in FIG. 9 will be provided for each opposite end of the tube 2.

It is clear that in this embodiment the entire arrangement is located between the upper and lower run or stringer of the chain 71 which is provided with gripper members 72 that are known from the art. The point to be made with respect to FIGS. 9 and 10 is that the drying arrangement according to the present invention can be installed in machines having the chain-type devices shown in FIGS. 9 and 10 without having in any way to disturb the arrangement of these devices.

Figure 11:
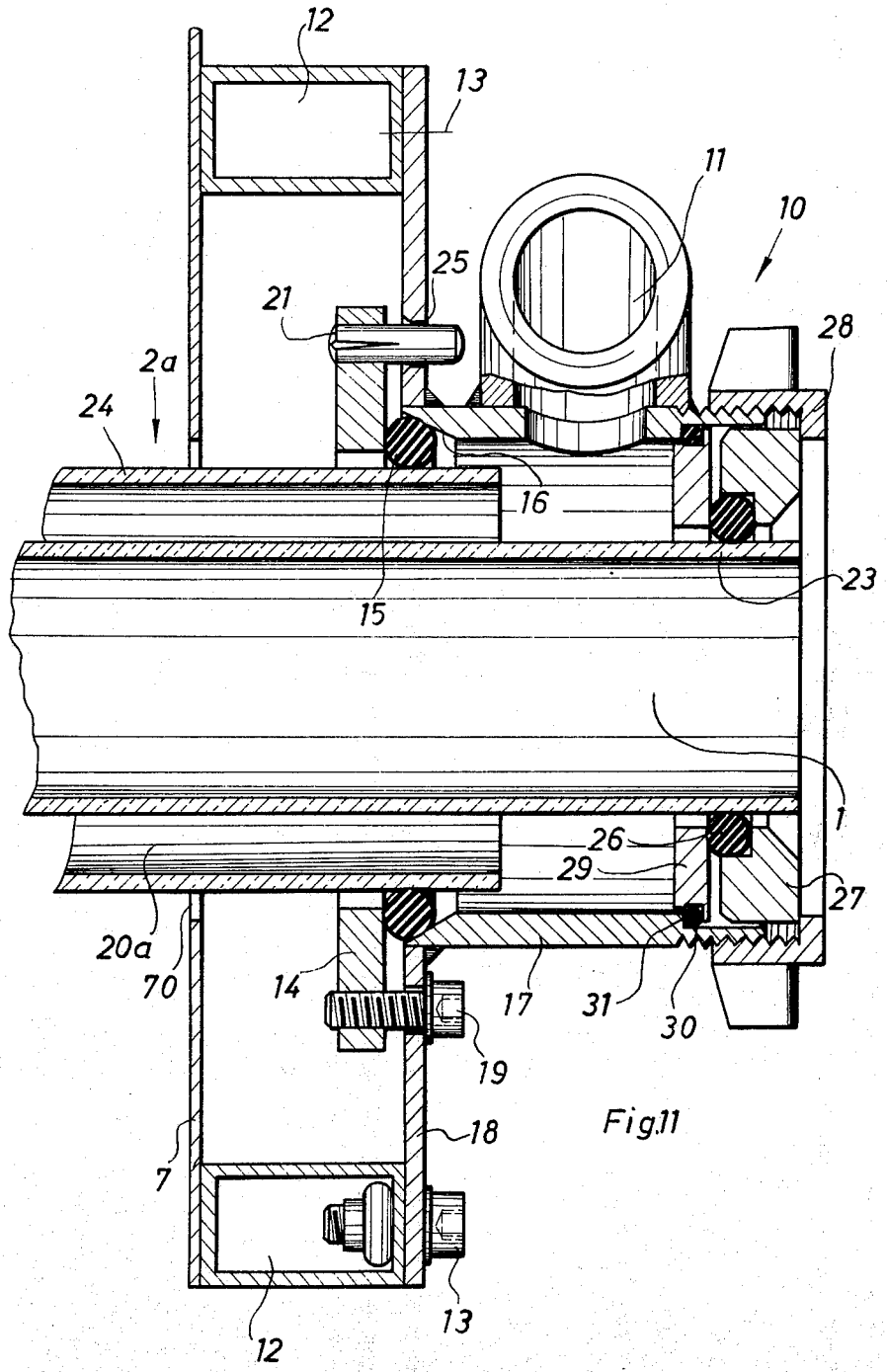
FIG. 11 is a fragmentary axial section of a further embodiment of the invention.
Figure 12:
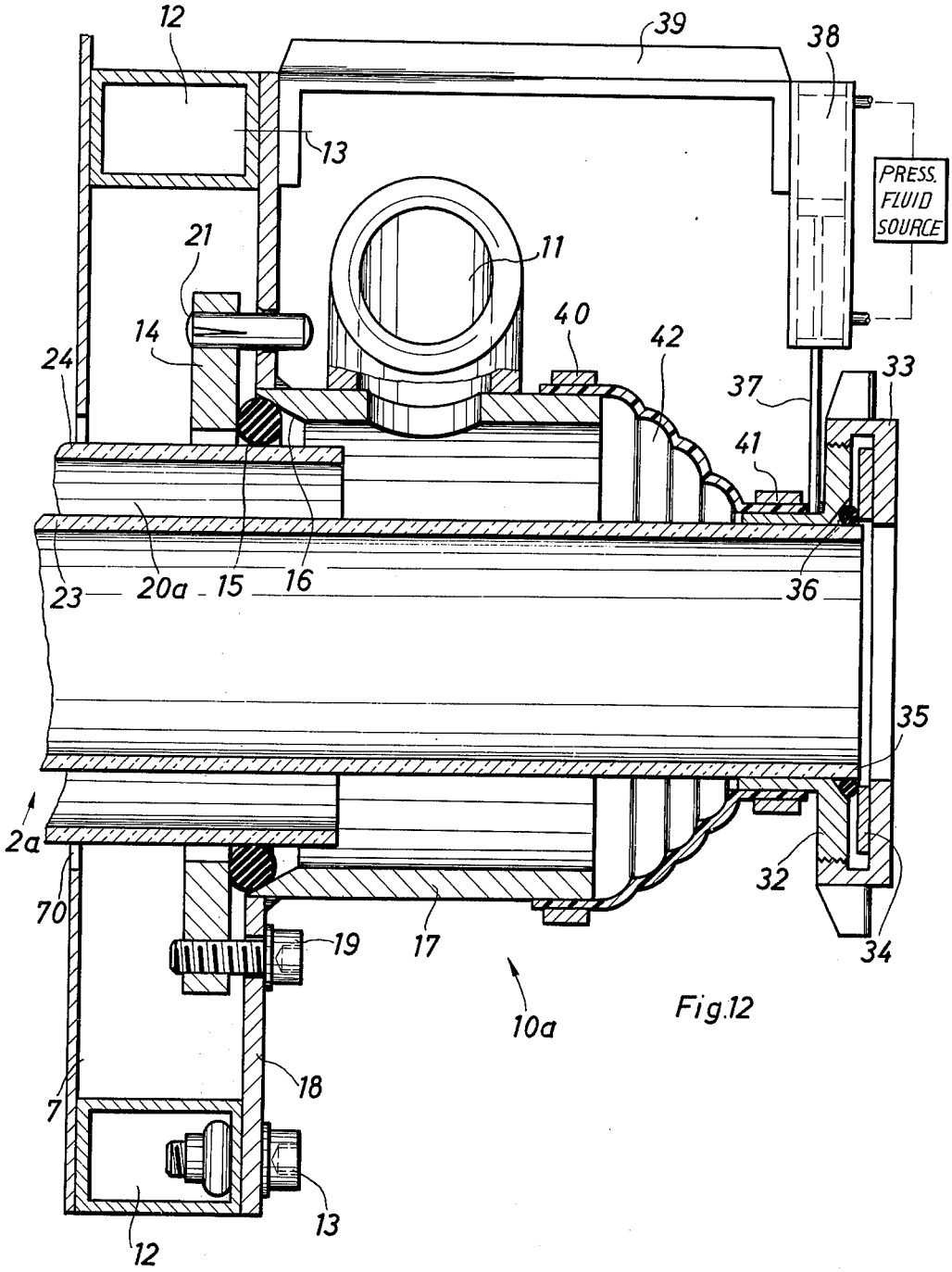
FIG. 12 is a view similar to FIG. 11, but showing still another embodiment of the invention.

FIGS. 11 and 12, finally, show particularly advantageous embodiments of the invention, and especially of the cooling means for the same. Both embodiments have in common that the cooling tube is of two parts, an outer part telescoped with clearance over an inner part, with the outer tube being identified with reference numeral 24 and the inner one with reference numeral 23. The embodiment of FIG. 11 shows that the UV source 1 is surrounded by a cooling jacket **2*a* composed of the inner tube 23 over which the outer tube 24 is telescoped and to surround it with clearance. In the region of the opposite axial ends (only one shown) of the two tubes 23 and 24, a sealing unit 10 is provided which seals the outer tube 24 with reference to the outer surface of the inner tube 23, so that the clearance 20*a* exists between them. The clearance 20*a* is sealed, and a cooling medium such as water or air, can be circulated through it. The cooling medium is admitted into the clearance 20*a* via an inlet nipple 11 which is a part of the sealing unit 10, and at the opposite axial end (which is not illustrated) the cooling medium is removed from the clearance 20*a* via a similar sealing unit 10 and the nipple 11** thereof.

The sealing unit 10 has the additional purpose of mounting the composite tube **2*a* which extends outwardly of the machine frame through the bore 70 thereof. The unit 10 is mounted by means of screws 13 on spacer members 12 which, in turn, are mounted on the frame 7. The spacer members 12** are entirely or at least in part of an elastically yieldable material (e.g., a yieldable plastic, such as polyvinylchloride or the like), in order to prevent the transmission of vibrations from the frame 7 to the composite tube 2*a*. However, they need of course not be of such yieldable material.

An annular mounting plate 14 is provided which presses a sealing ring 15 that surrounds the outer tube 24 into a conical recess 16 of a tubular socket 17, thus sealing the tube 24 with reference to the exterior thereof and holding it in the unit 10. The socket 17 is fixedly connected with a mounting flange 18 which is connected via the screws 13 to the spacing members 12. Also, the flange 18 permits the compression of the sealing ring 15 since the screws 19 pass through it and into the ring 14 which they draw against the sealing ring 15. The ring 14 is provided with notched pins 21 which enter into openings 25 provided for this purpose in the flange 18 into openings 25 provided for this purpose in the flange 18 and which serve to faciliate the installation of the disc 14, since the insertion of the pins 21 into the openings 25 causes a certain pre-centering with reference to the outer tube 24.

The inner tube 23 is longer than the outer tube 24 so that its opposite axial ends (only one shown) project beyond the outer tube 24 into the socket 17 where they are engaged by a sealing ring 26 which is pressed by a ring 27 that can be tightened by means of a cap nut 28 against a disc 29. The disc 29 is provided on its outer circumference with a further sealing ring 30 which, when the nut 28 is tightened, is pressed against an abutment shoulder 31 of the socket 17. This provides for a reliably sealed annular clearance 20*a* which is accessible only through the nipples 11 in which, incidentally, temperature and flow speed sensing devices (not illustrated because conventional) may be installed.

The two-part arrangement of the composite tube 2*a* has the substantial advantage that if cleaning is required, it is merely necessary to withdraw the inner tube 23 which is very simple, since all that is needed is to release the nut 28 and thereupon withdraw the tube 23. It is evident that before this can be done, the cooling fluid must be removed from the clearance 20*a*, whereupon the tube 23 can be removed and readily cleaned. Also, the inner surface of the outer tube 24 is then accessible for easy cleaning. The reinstallation of the tube 23 is equally simple as its withdrawal.

The two-part construction of the composite tube 2*a*, that is the construction thereof from the tubes 23 and 24, has an additional advantage in that it makes it possible to construct the tube 23 as well as the tube 24 as smooth-walled tubes, whereby the danger of a mechanical damage to the tubes during installation or removal, and during cleaning, is substantially reduced. Also, smooth-walled tubes are substantially less expensive to produce than a single double-walled tube which in addition, of course, must have nipples for inlet and outlet of cooling fluid which make it even more expensive.

FIG. 12, finally, shows a further embodiment of the invention which is also based upon the fact that the cooling tube 2*a* is of two parts, namely the inner tube 23 and the outer tube 24. This two-part construction makes it possible to mount the inner tube 23 radially movable with reference to the outer tube 24, so that the size of the clearance 20*a* may be increased at one side and decreased at the other side, meaning that in the increased portion more of the cooling fluid will flow per unit of time and thus a better cooling effect can be obtained and can be directed where such improved cooling is desired. For this purpose, the embodiment of FIG. 12 provides a holding ring 23 which is slipped onto each axial end of the inner tube 23 (only one shown) and onto which a cap screw 33 can be threaded which serves to press a sealing ring 35 that surrounds the outer surface of the tube 23, into a beveled recess 36 of the ring 32, thus sealing the inner tube at its outer surface. The holding ring 32 is fixedly connected with a piston ron 37 of a fluid-operated cylinder and piston unit 38, and is thus supported by this piston rod. The cylinder 38 is of the double-acting type and mounted on a holding arrangement 39 which, in turn, can be mounted together with the sealing unit 10*a* on the distance member 12. It is evident that by extending or retracting the piston rod 37, the inner tube 23 can be radially shifted with reference to the outer tube 24, to thus control the cooling effect and, in addition, to control, due to the differential dimension of the clearance 20*a*, the proportion of the amount of infrared radiation which can reach the sheet material. This can be desirable, because if the sheet material travels quite rapidly through the apparatus, it may be desired to permit some (or an increased amount of) infrared radiation to reach the sheet material, since due to the rapid travel of the sheet material a rapid heating (obtainable by the infrared radiation) of the sheet material to a certain point is desired, because such heating to a certain point will facilitate the polymerization of the ink or other substance by the UV radiation. Nevertheless, the IR radiation will never become sufficiently strong—due to the cooling arrangement according to the present invention—to cause any damage to the sheet material.

Because of the relative radial displaceability of the inner tube 23 with reference to the outer tube 24, a special connecting arrangement must be provided between them. In FIG. 12 this is achieved in that two ring clamps 40 and 41 secure the opposite axial ends of a bellows 42 of flexible material to the outer end of the sealing unit 10*a* and to the left-hand end of the holding ring 32, respectively. At the opposite end (not shown) the same arrangement is provided. The sealing of the outer tube 24 with reference to the unit 10*a* takes place in the same manner as described with respect to the unit 10 in FIG. 11.

In the embodiment of FIG. 12 the tube 22 can be removed equally as readily as in FIG. 11, and the tubes 23 and 24 can both be of the smooth-walled variety, and not require a double wall, as for instance in the embodiment of FIG. 3.

It is self-evident that the source 1 need not be completely surrounded by a cooling tube, as in the illustrated embodiments. If IR radiation to one side (i.e., away from the sheet material) is acceptable, then the cooling arrangement according to the present invention need only partially surround the source 1 at that side facing towards the sheet material. It is evident, of course, that a complete surrounding as in the illustrated embodiments is substantially preferable because it provides for a much better cooling.

It will be understood that each of the elements described above, or two or more together, may also find a useful application in other types of constructions differing from the type described above.

While the invention has been illustrated and described as embodied in a drying arrangement for drying of inks, adhesives and analogous substances on sheet material, it is not intended to be limited to the details shown since various modifications and structural changes may be made without departing in any way from the spirt of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an arrangement for drying inks, adhesives and analogous substances which polymerize when irradiated by UV radiation, particularly for use in printing machines in which as least one of the substances is applied to at least one major surface of a sheet material, a combination comprising guide means for guiding the sheet material in a path; drying means including a radiation source spaced from said path and adapted to emit UV radiation accompanied by incidental IR radiation at least toward the one major surface of the sheet material; and means for allowing UV radiation to reach the sheet material and for prohibiting the IR radiation from reaching the sheet material, said means comprising cooling means including a passage containing a cooling medium and located between said radiation source and at least the one major surface of the sheet material, said cooling means being permeable to the UV radiation but substantially impermeable to the IR radiation whereby the UV radiation passes through said cooling means and polymerizes the substance on the one major surface of the sheet material and the IR radiation is intercepted by said cooling means to prevent impingement upon the one major surface of the sheet material, the substance thereon, and parts of the arrangement, so that the same are protected from deleterious influences of the incidental IR radiation.

2. An arrangement as defined in claim 1, wherein said cooling means comprises a cooled glass tube surrounding said source.

3. An arrangement as defined in claim 1, wherein said cooling means comprises a cooled quartz tube surrounding said source.

4. An arrangement as defined in claim 1, wherein said cooling means comprises a tube of vitreous material permeable to the UV radiation and surrounding said source, said tube having double walls which define with one another a cooling jacket, and spaced-apart inlet and outlet openings communicating with said cooling jacket for circulation of a cooling fluid through the same.

5. An arrangement as defined in claim 4, wherein said tube is provided with inlet and outlet nipples having said inlet and outlet openings, respectively, and being composed of said vitreous material.

6. An arrangement as defined in claim 4, wherein said cooling means further comprises a source of cooled fluid, and conduit means connecting said source with said inlet and outlet openings, respectively.

7. An arrangement as defined in claim 6, wherein said cooling fluid is a liquid, and said source comprises a heat exchanger for cooling the liquid.

8. An arrangement as defined in claim 6, wherein said cooling fluid is a gaseous fluid; and further comprising a filter interposed between said source and said inlet opening for filtering contaminants out of said gaseous fluid.

9. An arrangement as defined in claim 1, wherein said cooling means comprises a cooled tube surrounding said source and composed of a material penetrable to the UV radiation; and further comprising reflector means partially surrounding said cooled tube and positioned to direct the UV radiation at said one major surface.

10. An arrangement as defined in claim 9, wherein said reflector means comprises a layer of aluminum paint on said cooled tube.

11. An arrangement as defined in claim 9, wherein said reflector comprises a layer of aluminum sheet on said cooled tube.

12. An arrangement as defined in claim 11; and further comprising a bonding agent which is penetrable by said UV radiation, bonding said aluminum sheet to said cooled tube.

13. An arrangement as defined in claim 1, said source being elongated and having spaced end portions; wherein said cooling means comprises a cooled tube surrounding said source with clearance and being composed of a material penetrable by UV radiation; and further comprising mounting means engaging said spaced end portions of said source and mounting the latter with said clearance in said tube.

14. An arrangement as defined in claim 13, said source also having a midle portion from which said radiation originates; and further comprising mica insulators on said end portions intermediate said mounting means and said middle portion.

15. An arrangement as defined in claim 13, said source also having a middle portion from which said radiation originates; and wherein said mounting means includes a pair of cup-shaped members each having a closed end facing towards said middle portion and having an opening through which one of said end portions extends, and an open end facing away from said middle portion; said mounting means further including a pair of stepped-cross-section collars of insulating material, each being slipped over one end of said tube and being secured to one of said cup-shaped members in the region of the open end of the same.

16. An arrangement as defined in claim 15, wherein each of said collars has a plurality of tongues extending longitudinally of the respective tube end exteriorly thereof; and further comprising clamping means clamping said tongues against said tube.

17. An arrangement as defined in claim 16, wherein said clamping means comprises for each of said collars an annulus of synthetic plastic foam material surrounding the respective tube end and tongues, and a tensioning, band surrounding the annulus and compressing the same against said tongues.

18. An arrangement as defined in claim 1, wherein said cooling means comprises a cooled tube surrounding said source with clearance and being composed of a material penetrable by said UV radiation; further comprising a support structure for said tube and formed with openings substantially larger than the outer diameter of the respective tube end portions, the latter each being received with annular clearance in one of said openings; a ring of synthetic plastic foam material surrounding each tube end portion within the respective annular clearance; and a tension band surrounding each ring and compressing the same against the associated tube end portion.

19. An arrangement as defined in claim 18, wherein said support structure comprises in the region of each tube end portion a pair of axially spaced and aligned annular flanges through which the associated tube end portion extends, and wherein the associated ring surrounds the tube end portion intermediate said annular flanges of the pair.

20. An arrangement as defined in claim 1, wherein said cooling means comprises a tube surrounding said source and having spaced end portions, and means for circulating a cooling fluid into heat-exchanging engagement with said tube; mounting means engaging said end portions of said tube for mounting the latter; and a cover at each of said end portions surrounding the same and provided with at least one opening for said cooling fluid.

21. An arrangement as defined in claim 1, wherein said cooling means comprises a tube surrounding said source, an inlet nipple for cooling fluid extending substantially radially of said tube and an outlet nipple for cooling fluid extending substantially axially of said tube, and means for circulating a cooling fluid in heat-exchanging contact with said tube via said inlet and outlet nipples.

22. An arrangement as defined in claim 21, further comprising an additional inlet nipple opposite the first-mentioned inlet nipple, and an additional outlet nipple opposite the first-mentioned outlet nipple.

23. An arrangement as defined in claim 1, wherein said cooling means comprises an inner tube surrounding said source, an outer tube surrounding said inner tube and defining with the same a clearance, sealing means sealing opposite axial ends of said clearance, and means for admitting a cooling fluid into and removing it from said clearance.

24. An arrangement as defined in claim 23, said tubes having spaced axial end portions, and said sealing means comprising a pair of sealing elements into which the respective end portions sealingly extend, said sealing elements being provided with said means for admitting and removing said cooling fluid.

25. An arrangement as defined in claim 24; further comprising holding means engaging the respective sealing elements and holding said outer tube spaced from said inner tube so as to define said clearance.

26. An arrangement as defined in claim 25, wherein said holding means is at least in part composed of an elastically yieldable material.

27. An arrangement as defined in claim 25, wherein each of said sealing elements comprises an annular flange and a tubular section fixedly connected to and aligned with said annular flange, said tubular section receiving end portions of said tubes and having an inner end formed with a conically enlarged diameter portion which accommodates a sealing ring in sealing engagement with the outer surface of said outer tube, said tubular section also having an outer end formed with an apertured transverse wall through which an end portion of said inner tube extends, and a sealing ring which sealingly engages said transverse wall and the outer surface of said inner tube.

28. A drying arrangement for drying inks, adhesives and analogous substances on sheet material, particularly for use in offset printing machines, comprising guide means for guiding the sheet material in a path in which the major surfaces of the sheet material are exposed; drying means, including a source of UV radiation and of incidental IR radiation, located adjacent said path and operative for directing the UV radiation against at least one of said major surfaces so as to dry a respective one of said substances thereon; cooling means at least partially surrounding said source for counteracting the heat of said incidental IR radiation and including an inner tube surrounding said source, an outer tube surrounding said inner tube and defining with the same a clearance, sealing means sealing opposite axial ends of said clearance, and means for admitting a cooling fluid into and removing it from said clearance; and mounting means mounting one of said tubes for displacement radially of the other of said tubes.

29. An arrangement as defined in claim 28, wherein said mounting means comprises a pair of ring members each sealingly surrounding one end portion of said inner tube; and a piston-and-cylinder unit mounted adjacent each end portion of said inner tube and connected with a respective ring member so as to displace the same and thereby said inner tube radially with reference to said outer tube when the respective unit is operated.

30. An arrangement as defined in claim 29, wherein each of said ring members has a recess extending circumferentially of said inner tube; further comprising a sealing member received in said recess and sealingly engaging said ring member and the outer surface of said inner tube.

31. An arrangement as defined in claim 29; further comprising mounting members engaging and axially projecting from each end portion of said outer tube; and further comprising a flexible bellows member surrounding the respective end portions of said inner tube and each being sealingly connected to one of said end portions of said inner tube and to one of said mounting member.

32. An arrangement as defined in claim 23, wherein said inner tube projects axially beyond said outer tube at least at one end of the latter.

33. In a printing machine, a combination comprising a plurality of printing stations in which at least one substance which polymerizes when irradiated by UV radiation, such as ink, adhesive and analogous substances, is applied to at least one major surface of a sheet material; an output station; guide means for successively guiding the sheet material in a path through said stations; and a plurality of drying arrangements located between at least two successive ones of said stations and each comprising drying means including a radiation source spaced from said path and adapted to emit UV radiation accompanied by incidental IR radiation at least toward the one major surface of the sheet material, and means for allowing UV radiation to reach the sheet material and for prohibiting the IR radiation from reaching the sheet material, said means comprising cooling means including a passage containing a cooling medium and located between said radiation source and at least the one major surface of the sheet material, said cooling means being permeable to the UV radiation but substantially impermeable to the IR radiation whereby the UV radiation passes through said cooling means and polymerizes the substance on the one major surface of the sheet material and the IR radiation is intercepted by said cooling means to prevent impingement upon the one major surface of the sheet material, the substance thereon, and parts of the arrangement, so that the same are protected from deleterious influences of the incidental IR radiation.

34. In a printing machine as defined in claim 33, wherein respective ones of said drying arrangements are located between successive ones of said printing stations.

35. In a printing machine as defined in claim 33, wherein all of said drying arrangements are grouped intermediate said printing stations and said output station.

36. In a printing machine as defined in claim 33, wherein said drying arrangements are grouped intermediate successive ones of said stations.

37. In a printing machine as defined in claim 33, wherein said printing machine has sheet-material transporting chains which form an upper and a lower run; and wherein said drying arrangements are located between said runs.

38. An arrangement as defined in claim 23, wherein both of said tubes are smooth-walled.

* * * * *